US005425208A

United States Patent [19]

Eekhout

[11] Patent Number: 5,425,208

[45] Date of Patent: Jun. 20, 1995

[54] DOT POINT GLAZING APPARATUS

[75] Inventor: Mick Eekhout, Rotterdamseweg, Netherlands

[73] Assignees: Octatube Space Structures, Netherlands; Central Glass Company, Ltd., Japan

[21] Appl. No.: 143,126

[22] Filed: Oct. 29, 1993

[30] Foreign Application Priority Data

Oct. 30, 1992 [JP] Japan ..... 4-293296
Mar. 30, 1993 [JP] Japan ..... 5-071688

[51] Int. Cl.[6] ..... E04B 2/88

[52] U.S. Cl. ..... 52/235; 403/188; 403/293

[58] Field of Search ..... 52/235, 582.1, 598.1, 52/587.1, 698; 403/188, 192, 292–294

[56] References Cited

U.S. PATENT DOCUMENTS

| | | | |
|---|---|---|---|
| 3,685,240 | 8/1972 | Oscari | 52/235 |
| 4,562,680 | 1/1986 | Sukolics | 52/235 X |
| 4,843,791 | 7/1989 | Michlovic | 52/235 |
| 4,854,095 | 8/1989 | Michlovic | 52/235 |

FOREIGN PATENT DOCUMENTS

| | | |
|---|---|---|
| 0201212 | 11/1986 | European Pat. Off. . |
| 2134167 | 1/1973 | German Dem. Rep. . |
| 64-10845 | 1/1989 | Japan . |
| 1-122110 | 8/1989 | Japan . |
| 8802764 | 6/1990 | Netherlands . |

OTHER PUBLICATIONS

M. A. Opici, "Vetrate Sospese", Nuova Finestra, vol. 13,No. 6, Jun. 1992, Milano, IT, pp. 177–187.

*Primary Examiner*—Carl O. Friedman
*Assistant Examiner*—Beth A. Aubrey
*Attorney, Agent, or Firm*—Cushman, Darby & Cushman

[57] ABSTRACT

A dot point glazing apparatus has a rod, a straight arm which engages one end of the rod at its center to be rotatable around the rod. A first V-shaped arm engages one end of the straight arm at its center to be rotatable around an axis extending parallel to the rod. A second V-shaped arm engages the other end of the straight arm at its center to be rotatable around an axis extending parallel to the rod. Bolts for supporting glass plates threadedly engage the ends of the V-shaped arms.

15 Claims, 10 Drawing Sheets

DOT POINT GLAZING APPARATUS

BACKGROUND OF THE INVENTION

The present invention relates to a dot point glazing apparatus for assembling glass plates into a glass screen.

Various types of glazing systems, such as the curtain wall system, the structural sealant glazing system, the dot point glazing system, etc., are used for assembling glass plates into a glass screen.

In the dot point glazing system, a dot point glazing apparatus engages holes made in the glass plates to support them.

The glazing apparatus 400 shown in FIG. 17 is one of the most effective dot point glazing apparatuses used in the dot point glazing system. As shown in FIG. 17, the dot point glazing apparatus 400 has a longitudinally extending rod 401 and a transversely extending straight arm 402 which engages the front end of the rod 401 at its center to be rotatable around the rod 401. A vertically extending straight arm 403*a* engages the right end of the straight arm 402 at its center to be rotatable around a longitudinally extending axis. A vertically extending straight arm 403*b* engages the left end of the straight arm 402 at its center to be rotatable around a longitudinally extending axis.

A longitudinally extending bolt 404$a_1$ penetrates a hole made at the left lower corner of a glass plate 405$a_1$ and a washer 406$a_1$, and is screwed into a tapped hole made at upper end of the straight arm 403*a*. Thus, the glass plate 405$a_1$ is connected to the dot point glazing apparatus 400 at its left lower corner. In the same way, a glass plate 405$a_2$ disposed adjacent to and below the glass plate 405$a_1$ is connected to the dot point glazing apparatus 400 at its left upper corner, a glass plate 405$b_1$ disposed adjacent to and left of the glass plate 405$a_1$ is connected to the dot point glazing apparatus 400 at its right lower corner, and a plate 405$b_2$ disposed adjacent to and below the glass plate 405$b_1$ is connected to the dot point glazing apparatus 400 at its right upper corner.

The glass plates 405$a_1$, 405$a_2$, 405$b_1$ and 405$b_2$ are connected to other similar dot point glazing apparatuses 400 (not shown) disposed at the other corners of the glass plates 405$a_1$, 405$a_2$, 405$b_1$ and 405$b_2$.

The rods 401 are connected to structural members which are disposed to the rear of the dot point glazing apparatuses 400 at their rear ends.

A glass screen module is formed by the glass plates 405$a_1$, 405$a_2$, 405$b_1$ and 405$b_2$. A plurality of the glass screen modules may be assembled in the vertical direction and in the transverse direction to form a glass screen.

The glazing apparatuses 400 bear the weights of the glass plates 405$a_1$, 405$a_2$, 405$b_1$ and 405$b_2$, and the wind loads acting on the glass plates 405$_1$, 405$a_2$, 405$b_1$ and 405$b_2$.

In-plane vertical relative displacements between the glass plates 405$a_1$ and 405$b_1$, and between the glass plates 405$a_2$ and 405$b_2$ are allowed by the rotation of the transverse straight arm 402, while in-plane horizontal relative displacements between the glass plates 405$a_1$ and 405$a_2$, and between the glass plates 405$b_1$ and 405$b_2$ are allowed by the rotation of the right vertical straight arm 403*a*, and the left vertical straight arm 403*b* respectively.

Thus, shear deformation of the glass screen module is allowed when an earthquake occurs, which protects the glass screen module from damage.

As will be understood from the above explanation, the dot point glazing apparatus 400 shown in FIG. 17 can effectively protect the glass screen module from damage when an earthquake occurs.

Though the dot point glazing apparatus 400 has the above merit, it has also a demerit. Once the transverse straight arm 402 has rotated, it does not readily restore to the original state. As a result, the in-plane vertical relative displacements between the glass plates 405$a_1$ and 405$b_1$, and between the glass plates 405$a_2$ and 405$b_2$, do not readily disappear after the earthquake stops. Because of this, the shear deformation of the glass screen module does not readily disappear after the earthquake stops. In order to overcome the above demerit, the upper most glass plates in the glass screen module, i.e. the glass plates 405$a_1$, 405$b_1$ must be suspended by spring members at the centers of their upper peripheries.

SUMMARY OF THE INVENTION

An object of the present invention is to provide a dot point glazing apparatus for assembling glass plates into a glass screen which can effectively protect the glass screen from damage when an earthquake occurs and readily restore the shear deformed glass screen to the original state after the earthquake stops.

In accordance with the present invention, there is provided a dot point glazing apparatus comprising a rod, a straight arm which engages one end of the rod at its center to be rotatable around the rod, a first V-shaped arm which engages one end of the straight arm at its center to be rotatable around an axis extending parallel to the rod, a second V-shaped arm which engages the other end of the straight arm at its center to be rotatable around an axis extending parallel to the rod, and four bolts which threadedly engage the ends of the V-shaped arms.

In accordance with a preferred embodiment of the present invention, there is provided a dot point glazing apparatus comprising a rod, a straight arm which engages one end of the rod at its center to be rotatable around the rod, a V-shaped arm which engages one end of the straight arm at its center to be rotatable around an axis extending parallel to the rod, two bolts which threadedly engage the ends of the V-shaped arm.

In accordance with another preferred embodiment of the present invention, there is provided a dot point glazing apparatus comprising a rod, a first straight arm which engages one end of the rod at its center to be rotatable around the rod, a second straight arm which engages one end of the first straight arm at its one end to be rotatable around an axis extending parallel to the rod, a third straight arm which engages the other end of the first straight arm at its one end to be rotatable around an axis extending parallel to the rod, and two bolts which threadedly engage the other ends of the second and the third straight arms.

In accordance with another preferred embodiment of the present invention, there is provided a dot point glazing apparatus comprising a rod, a first straight arm which engages one end of the rod at its center to be rotatable around the rod, a second straight arm which engages one end of the first straight arm at its one end to be rotatable around an axis extending parallel to the rod, and a bolt which threadedly engages the other end of the second arm.

In accordance with another aspect of the present invention, there is provided a dot point glazing system which comprises:

(a) a plurality of first dot point glazing apparatuses each of which has a rod, a straight arm which engages one end of the rod at its center to be rotatable around the rod, a first V-shaped arm which engages one end of the straight arm at its center to be rotatable around an axis extending parallel to the rod, a second V-shaped arm which engages the other end of the straight arm at its center to be rotatable around an axis extending parallel to the rod, and four bolts which threadedly engage the ends of the V-shaped arms;

(b) a plurality of second dot point glazing apparatuses each of which has a rod, a straight arm which engages one end of the rod at its center to be rotatable around the rod, a V-shaped arm which engages one end of the straight arm at its center to be rotatable around an axis extending parallel to the rod, and two bolts which threadedly engage the ends of the V-shaped arm;

(c) a plurality of third dot point glazing apparatuses each of which has a rod, a first straight arm which engages one end of the rod at its center to be rotatable around the rod, a second straight arm which engages one end of the first straight arm at its one end to be rotatable around an axis extending parallel to the rod, a third straight arm which engages the other end of the first straight arm at its one end to be rotatable around an axis extending parallel to the rod, and two bolts which threadedly engage the other ends of the second and the third straight arms;

(d) a plurality of fourth dot point glazing apparatuses each of which has a rod, a first straight arm which engages one end of the rod at its center to be rotatable around the rod, a second straight arm which engages one end of the first straight arm at its one end to be rotatable around an axis extending parallel to the rod, and a bolt which threadedly engages the other end of the second arm; and (e) rods which connect the first, the second, the third, and the fourth dot point glazing apparatuses to structural members.

Further objects, features and advantages of the present invention will become apparent from the Detailed Description of the Preferred Embodiments when read in conjunction with the accompanying drawings.

DETAILED DESCRIPTION OF THE PREFERRED EMBODIMENTS

Figure 16:
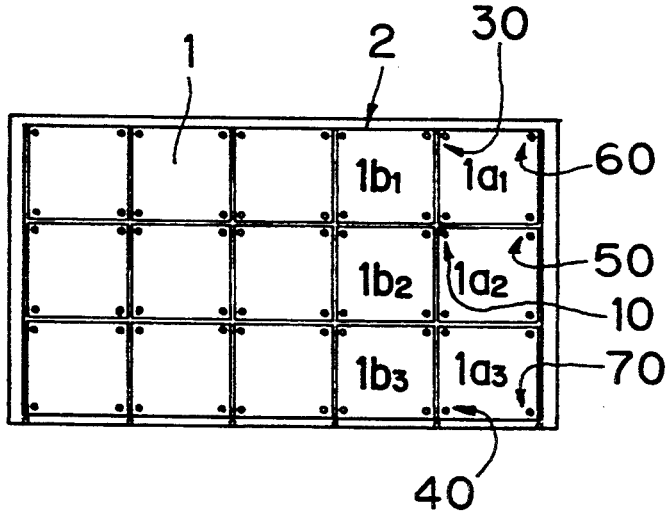
FIG. 16 is a front view of the glass screen of FIG. 15 as view in the direction of the arrow G.
Figure 17:
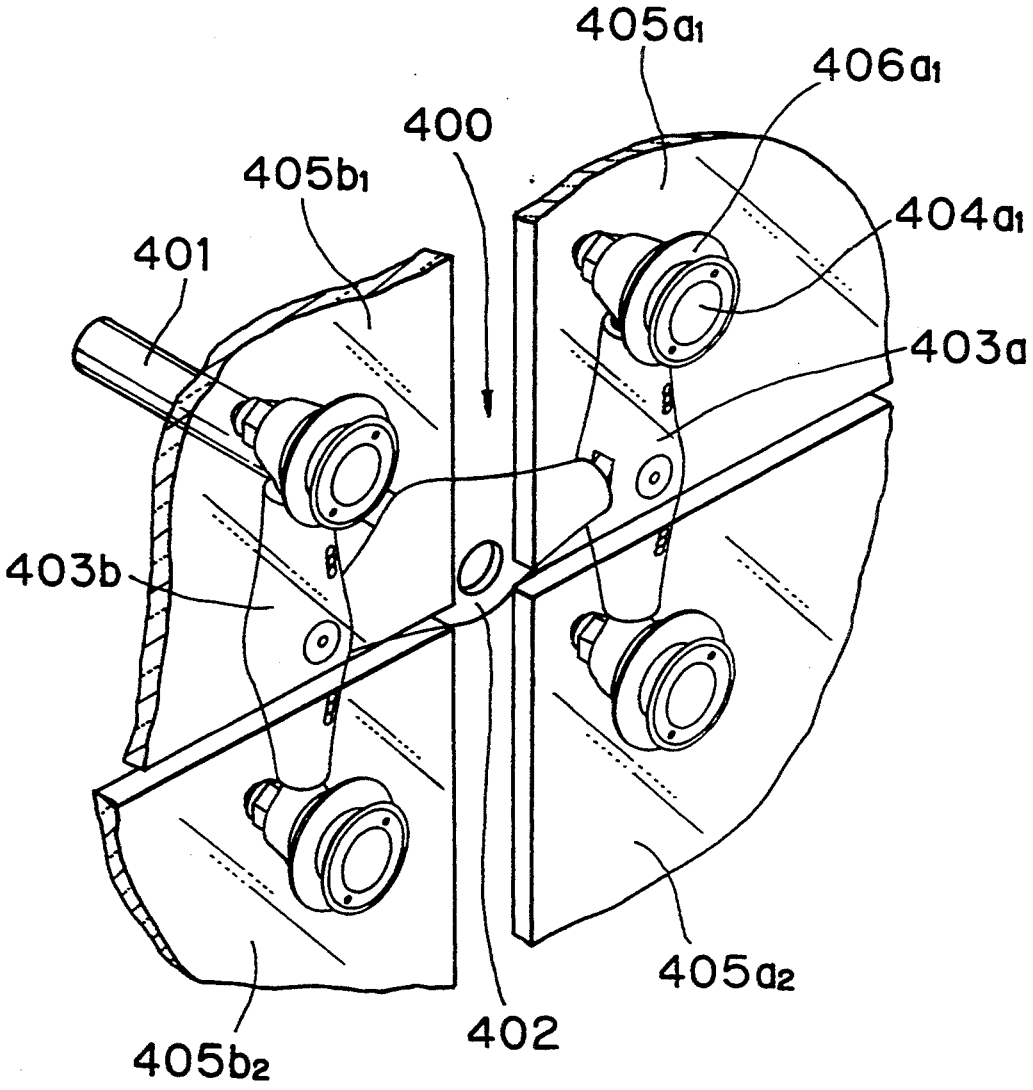
Fig.17 (PRIOR ART)
FIG. 17 is a perspective view of the conventional dot point glazing apparatus.

As shown in FIG. 16, a plurality of glass plates 1 are disposed adjacent to each other in the transverse direction and in the vertical direction to define a glass screen 2.

In the top row of the glass plates, the glass plates 1 are connected to dot point glazing apparatuses 30 at their right and left upper corners and to dot point glazing apparatuses 10 at their right and left lower corners, except for the rightmost and the leftmost glass plates 1. The rightmost glass plate 1 is connected to a dot point glazing apparatus 60 at its right upper corner and to a dot point glazing apparatus 50 at its right lower corner. The leftmost glass plate 1 is connected to the dot point glazing apparatus 60 at its left upper corner and to the dot point glazing apparatus 50 at its left lower corner.

In the middle row of the glass plates, the glass plates 1 are connected to the dot point glazing apparatuses 10 at their four corners, except for the rightmost and the leftmost glass plates 1. The rightmost glass plate 1 is connected to the dot point glazing apparatuses 50 at its right upper and right lower corners. The leftmost glass plate 1 is connected to the dot point glazing apparatuses 50 at its left upper and left lower corners.

In the bottom row of the glass plates, the glass plates 1 are connected to the dot point glazing apparatuses 10 at their right and left upper corners and to the dot point glazing apparatuses 40 at their right and left lower corners, except for the rightmost and the leftmost glass plates 1. The rightmost glass plate 1 is connected to the dot point glazing apparatus 50 at its right upper corner and to a dot point glazing apparatus 70 at its right lower corner. The leftmost glass plate 1 is connected to the dot point glazing apparatus 50 at its left upper corner and to the dot point glazing apparatus 70 at its left lower corner.

The dot point glazing apparatuses 10, 30, 20, 50, 60 and 70 will be described in detail, with particular attention being paid to glass plates $1a_1$, $1a_2$, $1a_3$ in the rightmost column of the glass plates and the glass plates $1b_1$, $1b_2$, $1b_3$ in the column of the glass plates next to the rightmost column.

Dot point glazing apparatus 10

Figure 1:
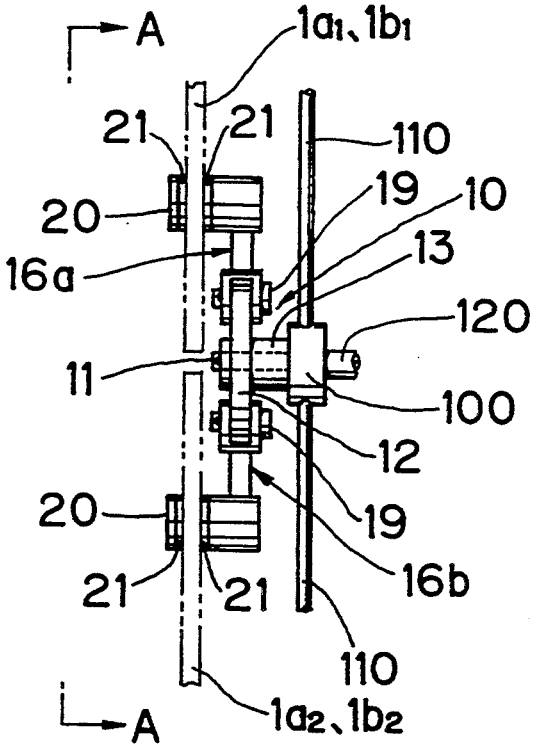
FIG. 1 is a side view showing a dot point glazing apparatus in accordance with a preferred embodiment of the present invention.
Figure 2:
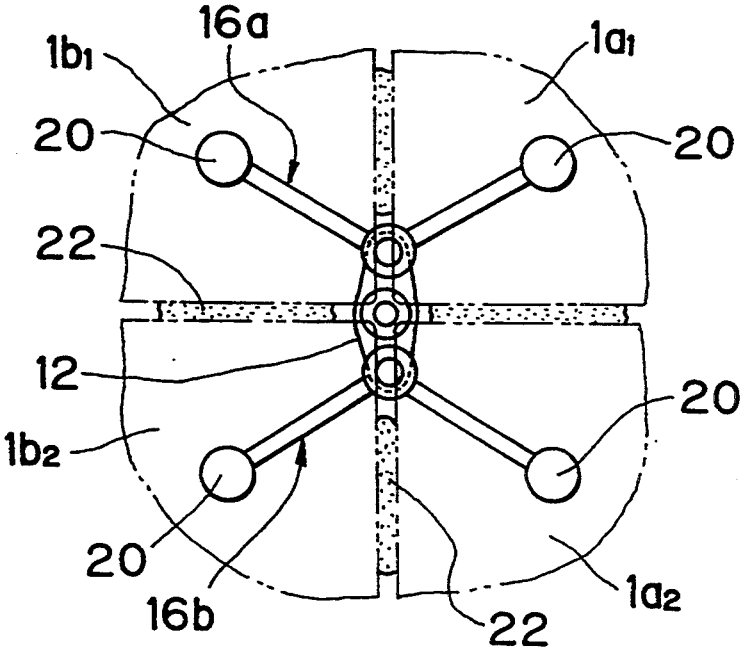
FIG. 2 is a front view of the dot point glazing apparatus of FIG. 1 as viewed in the direction of the arrow A.
Figure 3:
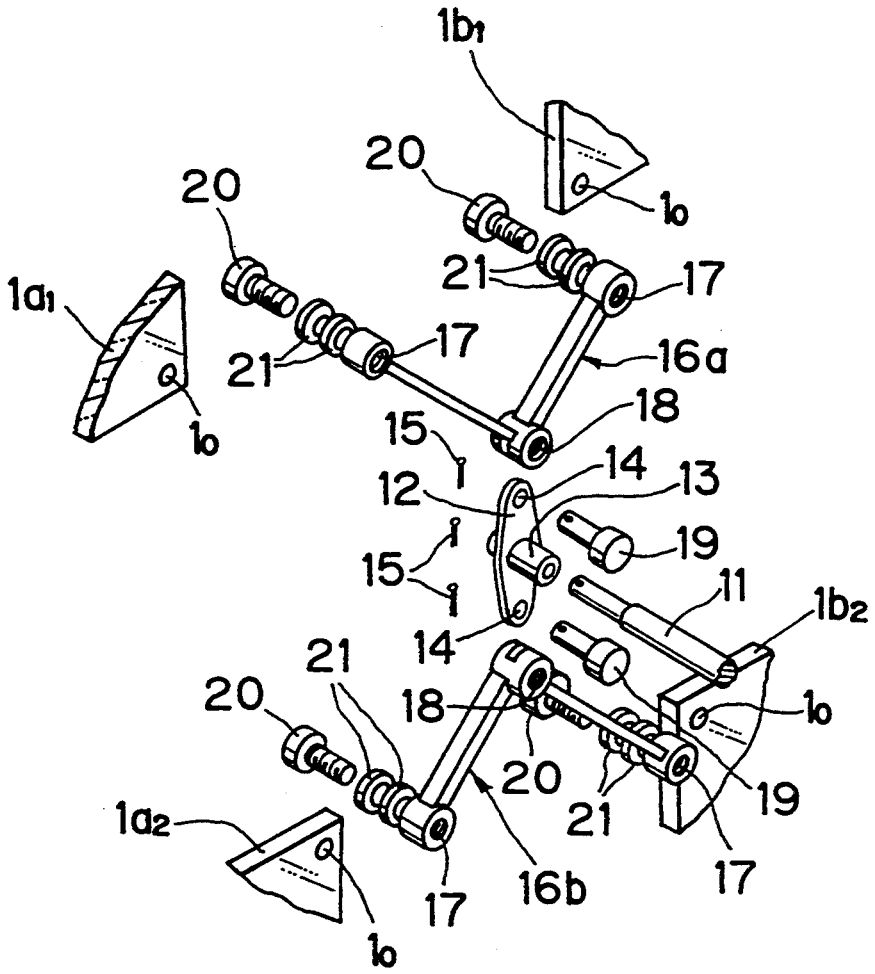
FIG. 3 is a perspective view of the dot point glazing apparatus of FIG. 1.

As shown in FIGS. 1 to 3, the dot point glazing apparatus 10 has a longitudinally extending rod 11 and a vertically extending straight arm 12 which is provided with a boss 13 at its center and a hole 14 at each of its upper and lower ends. The front end portion of the rod 11 penetrates the boss 13. A split pin 15 engages the front end of the rod 11. Thus, the straight arm 12 engages the rod 11 to be rotatable around the rod 11.

A V-shaped arm 16*a* is provided with a tapped hole 17 at each of its right and left upper ends and a tapped hole 18 at its yoke-shaped center. The yoke-shaped center of the V-shaped arm 16*a* engages the upper end of the straight arm 12. A longitudinally directed headed pin 19 penetrates the tapped hole 18 and the hole 14 disposed at the upper end of the straight arm 12. A split pin 15 engages the front end of the pin 19. Thus, the V-shaped arm 16*a* engages the upper end of the straight arm 12 to be rotatable around the pin 19.

A longitudinally directed bolt 20 penetrates a hole $1_0$ formed at left lower corner of a glass plate $1a_1$ and a pair of packing rings 21 which are disposed on opposite sides of the glass plate $1a_1$. The bolt 20 is screwed into the tapped hole 17 disposed at the right upper end of the V-shaped arm 16*a*. Thus the glass plate $1a_1$ is connected to the right upper end of the V-shaped arm 16*a* at its left lower corner. In the same way, a glass plate $1b_1$ which is disposed adjacent to and left of the glass plate $1a_1$ is connected to the left upper end of the V-shaped arm 16*a* at its right lower corner.

A V-shaped arm 16*b* which has the same configuration as the V-shaped arm 16*a* but is inverted with respect thereto engages the lower end of the straight arm 12 to be rotatable in the same way as the V-shaped arm 16*a*. A glass plate $1a_2$ which is disposed adjacent to and below the glass plate $1a_1$ is connected to the right lower end of the V-shaped arm 16*b* and a glass plate $1b_2$ which is disposed adjacent to and below the glass plate $1b_1$ is connected to the left lower end of the V-shaped arm 16*b* in the same way as the glass plates $1a_1$ and $1b_1$. Spaces between the adjacent glass plates $1a_1$, $1a_2$, $1b_1$, $1b_2$ are filled with sealant 22.

Figure 15:
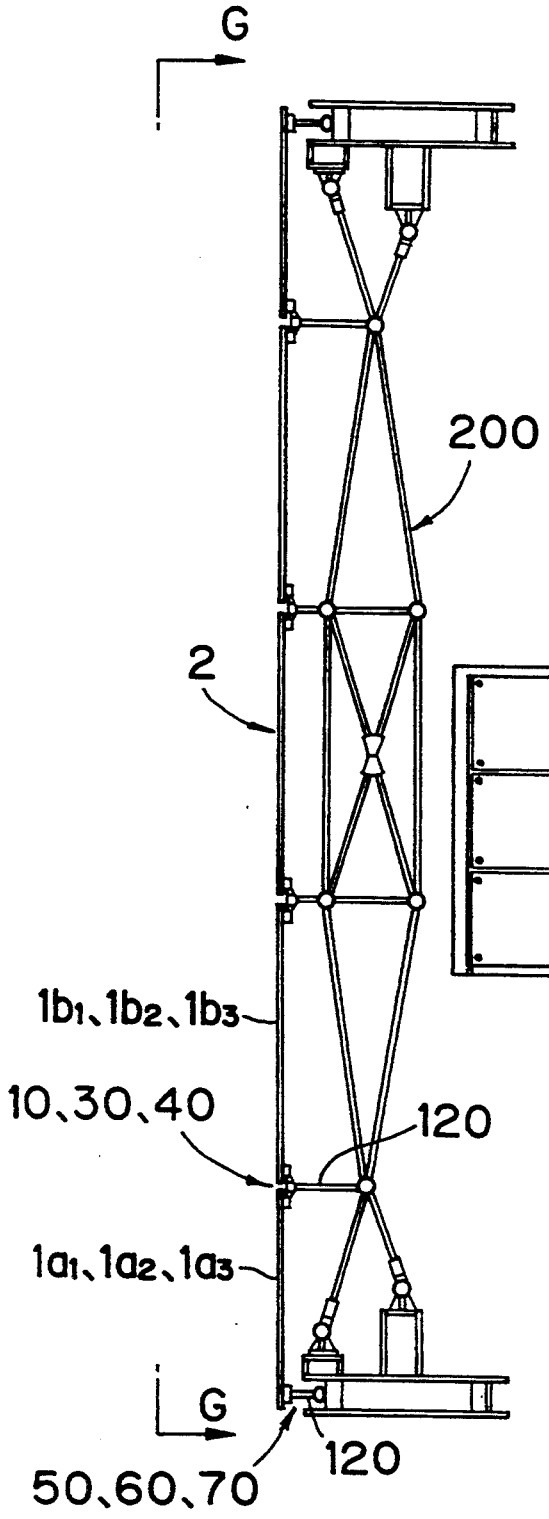
FIG. 15 is a plan view of a glass screen constituted by the dot point glazing apparatuses in accordance with the embodiments of the present invention and glass plates which are connected to the dot point glazing apparatuses at their corners.

The rod 11 is connected to a joint member 100 at its rear end. Rods 110 extend upward and downward from the joint member 100. The upwardly extending rod 110 is connected to the joint member 100 to which the rod 11 of the upwardly adjacent dot point glazing apparatus is connected, while the downwardly extending rod 110 is connected to the joint member 100 to which the rod 11 of the downwardly adjacent dot point glazing apparatus is connected. A rod 120 extends rearwardly from the joint member 100. As shown in FIG. 15, the rod 120 is connected to a truss structure 200 which is disposed to the rear of the glass screen 2 at its rear end.

Dot point glazing apparatus 30

Figure 4:
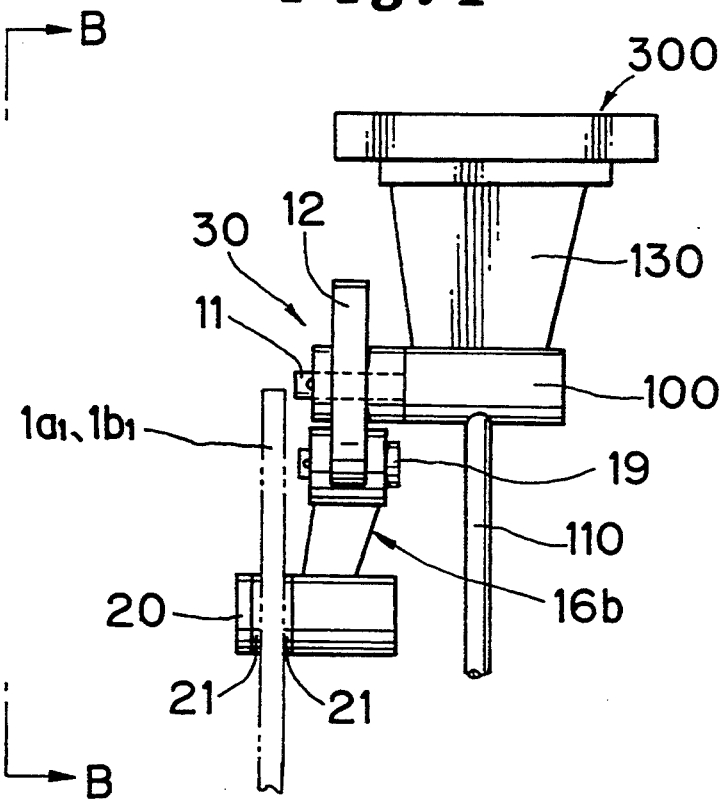
FIG. 4 is a side view showing a dot point glazing apparatus in accordance with another embodiment of the present invention.
Figure 5:
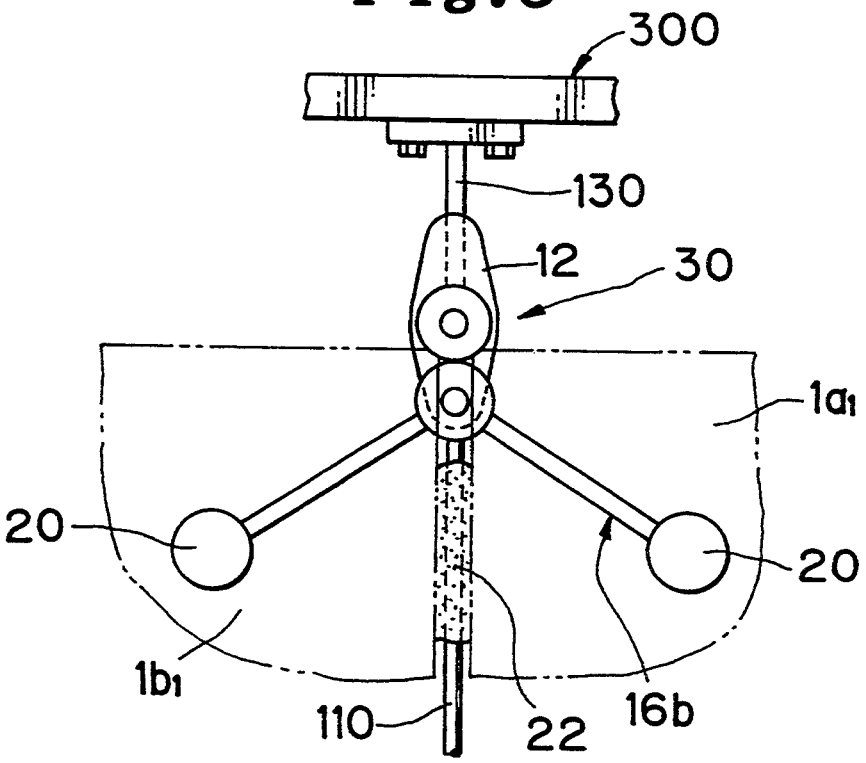
FIG. 5 is a front view of the dot point glazing apparatus of FIG. 4 as viewed in the direction of the arrow B.

As shown in FIGS. 4 and 5, the dot point glazing apparatus 30 has the same construction as the dot point glazing apparatus 10 except that it does not have the V-shaped arm 16*a*.

The glass plate $1a_1$ is connected to the right lower end of the V-shaped arm 16*b* at its left upper corner and the glass plate $1b_1$ is connected to the left lower end of the V-shaped arm 16*b* at its right upper corner in the same way as the glass plates $1a_2$ and $1b_2$. The space between the glass plates $1a_1$ and $1b_1$ is filled with the sealant 22.

The rod 11 is connected to the joint member 100 in the same way as the dot point glazing apparatus 10. The joint member 100 is fixed to the lower surface of a structural member 300 through a bracket 130. The rod 110 which downwardly extends from the joint member 100 is connected to the joint member 100 to which the rod 11 of the downwardly adjacent dot point glazing apparatus is connected.

Dot point glazing apparatus 40

Figure 6:
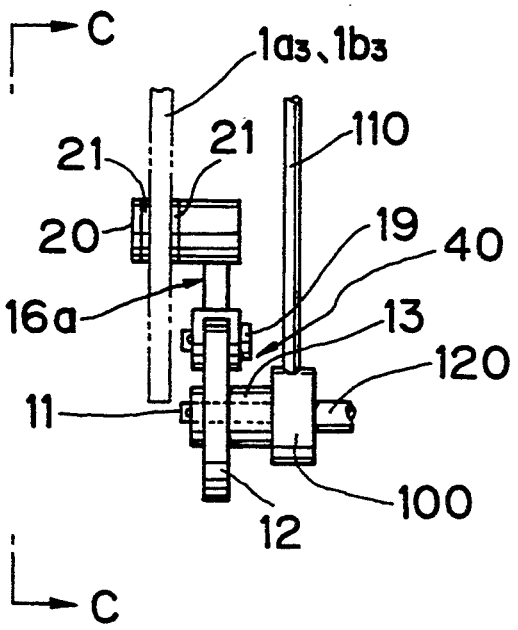
FIG. 6 is a side view showing a dot point glazing apparatus in accordance with another embodiment of the present invention.
Figure 7:
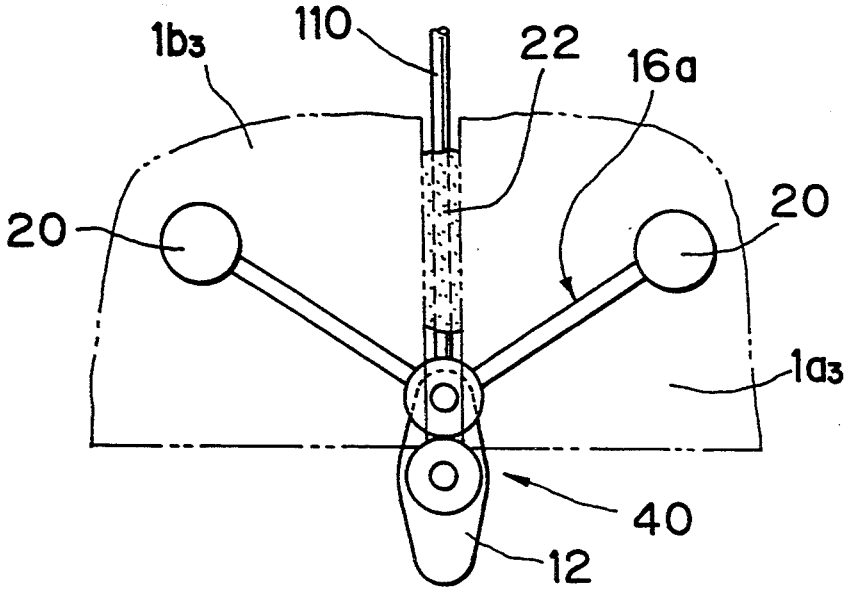
FIG. 7 is a front view of the dot point glazing apparatus of FIG. 6 as viewed in the direction of the arrow C.

As shown in FIGS. 6 and 7, the dot point glazing apparatus 40 has the same construction as the dot point glazing apparatus 10 except that it does not have the V-shaped arm 16*b*.

A glass plate la 3 is connected to the right upper end of the V-shaped arm 16*a* at its left lower corner and a glass plate $1b_3$ is connected to the left upper end of the arm 16*a* at its right lower corner in the same way as the glass plates $1a_1$ and $1b_1$. The space between the adjacent glass plates $1a_3$ and $1b_3$ is filled with the sealant 22.

The rod 11 is connected to the joint member 100 in the same way as the dot point glazing apparatus 10. The rod 110 which upwardly extends from the joint member 100 is connected to the joint member 100 to which the rod 11 of the upwardly adjacent dot point glazing apparatus is connected.

The rod 120 which extends rearwardly from the joint member 100 is connected to the truss structure 200 in the same way as the dot point apparatus 10.

Dot point glazing apparatus 50

Figure 8:
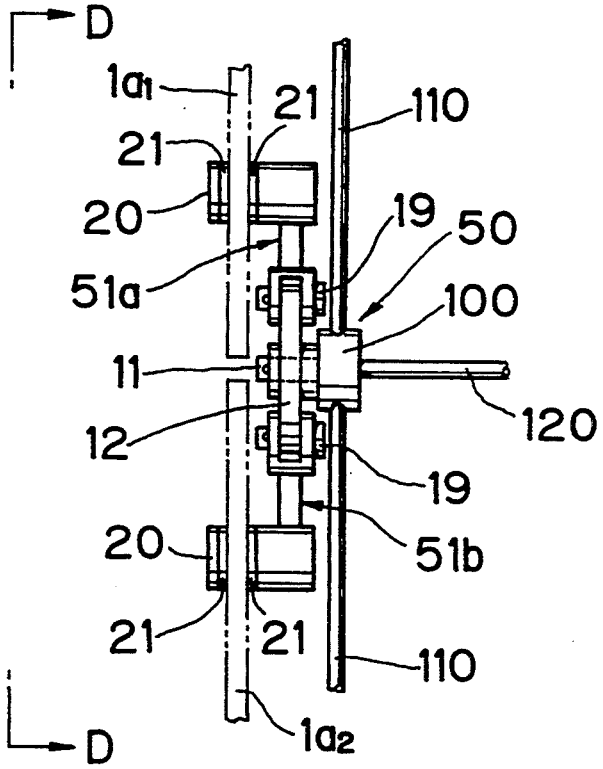
FIG. 8 is a side view showing a dot point glazing apparatus in accordance with another preferred embodiment of the present invention.
Figure 9:
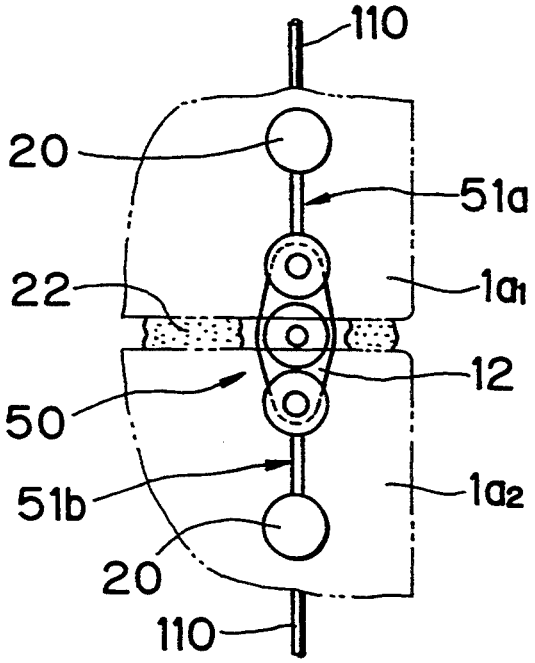
FIG. 9 is a front view of the dot point glazing apparatus of FIG. 8 as viewed in the direction of the arrow D.
Figure 10:
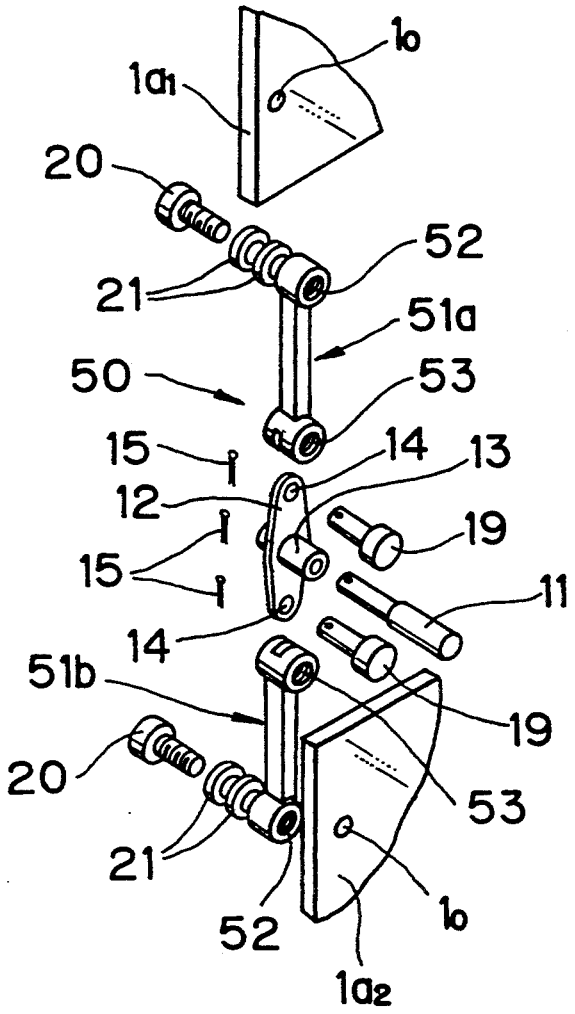
FIG. 10 is a perspective view of the dot point glazing apparatus of FIG. 8.

As shown in FIGS. 8 to 10, the dot point glazing apparatus 50 has a longitudinally extending rod 11 and a vertically extending straight arm 12 which is provided with a boss 13 at its center and a hole 14 at each of its upper and lower ends. The front end portion of the rod 11 penetrates the boss 13. A split pin 15 engages the front end of the rod 11. Thus, the straight arm 12 engages the rod 11 to be rotatable around the rod 11.

A vertically extending straight arm 51*a* is provided with a tapped hole 52 at its upper end and a tapped hole 53 at its yoke-shaped lower end. The yoke-shaped lower end of the straight arm 51*a* engages the upper end of the straight arm 12. A longitudinally directed headed pin 19 penetrates the tapped hole 53 and the hole 14 disposed at the upper end of the straight arm 12. A split pin 15 engages the front end of the pin 19. Thus, the straight arm 51*a* engages the upper end of the straight arm 12 to be rotatable around the pin 19.

A longitudinally directed bolt 20 penetrates a hole $1_0$ formed at the right lower corner of the glass plate $1a_1$ and a pair of packing rings 21 which are disposed on opposite sides of the glass plate $1a_1$. The bolt 20 is screwed into the tapped hole 52 disposed at the upper end of the straight arm 51*a*. Thus the glass plate $1a_1$ is connected to the upper end of the straight arm 51*a* at its right lower corner.

A vertically extending straight arm 51*b* which has the same configuration as the straight arm 51*a* but is inverted with respect thereto engages the lower end of the straight arm 12 to be rotatable in the same way as the straight arm 51*a*. A glass plate $1a_2$ which is disposed adjacent to and below the glass plate $1a_1$ is connected to the lower end of the straight arm 51*b* at its right upper corner in the same way as the glass plate $1a_1$. The space between the adjacent glass plates $1a_1$ and $1a_2$ is filled with sealant 22.

The rod 11 is connected to a joint member 100 at its rear end. Rods 110 extend upward and downward from the joint member 100. The upwardly extending rod 110 is connected to the joint member 100 to which the rod 11 of the upwardly adjacent dot point glazing apparatus is connected, while the downwardly extending rod 110 is connected to the joint member 100 to which the rod 11 of the downwardly adjacent dot point glazing apparatus is connected. A rod 120 extends rearwardly from the joint member 100. As shown in FIG. 15, the rod 120 is connected to a truss structure 200 which is disposed to the rear of the glass screen 2 at its rear end.

Dot point glazing apparatus 60

Figure 11:
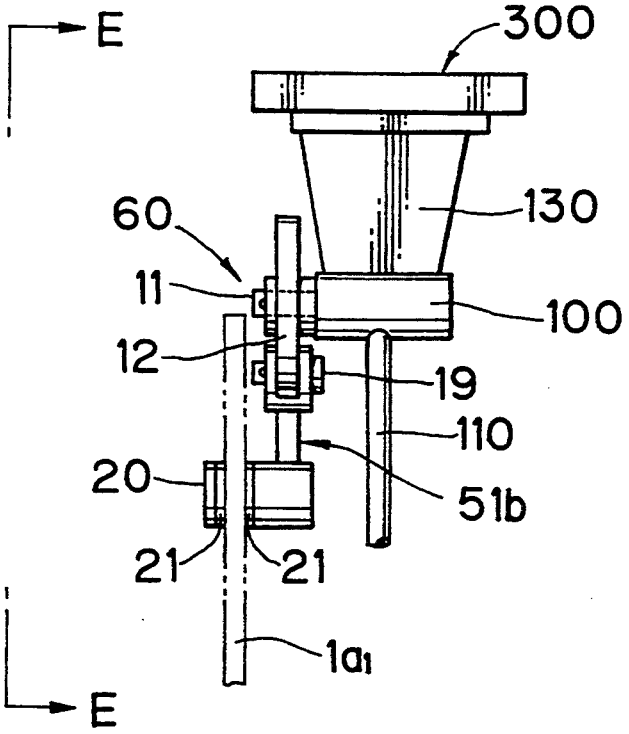
FIG. 11 is a side view showing a dot point glazing apparatus in accordance with another embodiment of the present invention.
Figure 12:
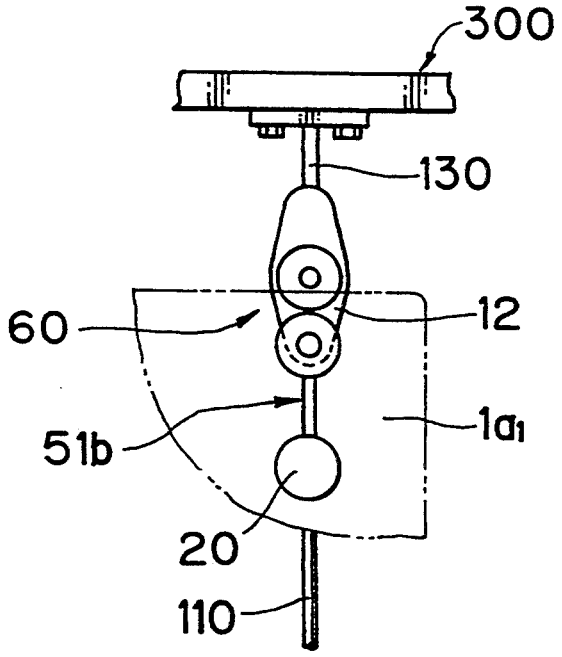
FIG. 12 is a front view of the dot point glazing apparatus of FIG. 11 as viewed in the direction of the arrow E.

As shown in FIGS. 11 and 12, the dot point glazing apparatus 60 has the same construction as the dot point glazing apparatus 50 except that it does not have the straight arm 51*a*.

A glass plate $1a_1$ is connected to the lower end of the straight arm 51*b* at its right upper corner in the same way as the glass plate $1a_2$.

The rod 11 is connected to the joint member 100 in the same way as the dot point glazing apparatus 50. The joint member 100 is fixed to the lower surface of a structural member 300 through a bracket 130. The rod 110 which downwardly extends from the joint member 100 is connected to the joint member 100 to which the rod 11 of the downwardly adjacent dot point glazing apparatus is connected.

Dot point glazing apparatus 70

Figure 13:
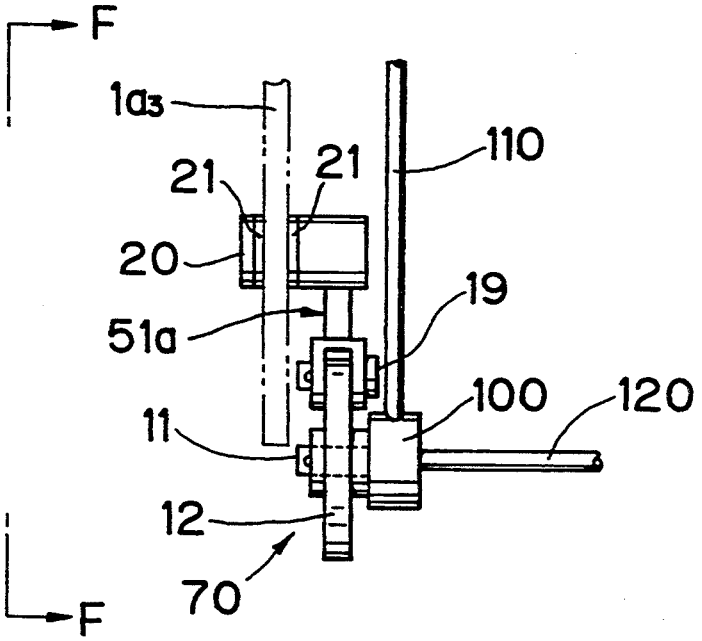
FIG. 13 is a side view showing a dot point glazing apparatus in accordance with another embodiment of the present invention.
Figure 14:
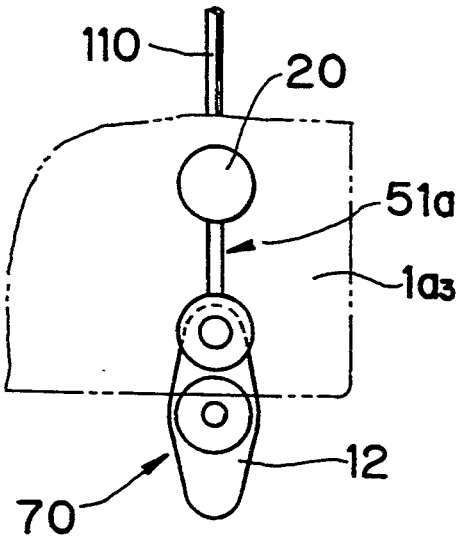
FIG. 14 is a front view of the dot point glazing apparatus of FIG. 13 as viewed in the direction of the arrow F.

As shown in FIGS. 13 and 12, the dot point glazing apparatus 70 has the same construction as the dot point glazing apparatus 50 except that it does not have the straight arm 51*b*.

A glass plate $1a_3$ is connected to the upper end of the straight arm 51*a* at its right lower corner in the same way as the glass plates $1a_1$.

The rod 11 is connected to the joint member 100 in the same way as the dot point glazing apparatus 50. The rod 110 which upwardly extends from the joint member 100 is connected to the joint member 100 to which the rod 11 of the upwardly adjacent dot point glazing apparatus is connected.

The rod 120 which extends rearwardly from the joint member 100 is connected to a truss structure 200 in the same way as the dot point apparatus 50.

The above described dot point glazing apparatuses operate as follows.

Dot point glazing apparatus 10

The V-shaped arm 16*a* supports the glass plates $1a_1$ and $1b_1$ against wind loads directed perpendicular to their surfaces. The V-shaped arm 16*b* supports the glass plates $1a_1$ and $1b_2$ against their weights as well as against the wind loads acting on them. The wind loads are transmitted from the V-shaped arms 16*a* and 16*b* to the truss structure 200 through the rod 11, the joint member 100 and the rod 120. The weights of the glass plates $1a_1$ and $1b_2$ together with the weights of the glass plates $1a_3$ and $1b_3$ are transmitted to the joint member 100 of the upwardly adjacent dot point glazing apparatus 30 through the upwardly extending rod 110.

In-plane vertical relative displacements between the glass plates $1a_1$ and $1b_1$, and between the glass plates $1a_2$ and $1b_2$, are allowed by the rotation of the V-shaped arm 16*a* and the V-shaped arm 16*b* respectively, while in-plane horizontal relative displacements between the glass plates $1a_1$ and $1a_2$, and between the glass plates $1b_1$ and $1b_2$, are allowed by the rotation of the straight arm 12. Thus, a shear deformation of the glass screen 2 is allowed when an earthquake occurs, which protects the glass screen 2 from damage.

When the straight arm 12 rotates, a restoring moment is generated by the weights of the glass plates $1a_2$ and $1b_1$. Thus, the straight arm 12 readily restores to the original equilibrium state after the earthquake stops. As a result, the in-plane horizontal relative displacements between the glass plates $1a_1$ and $1a_2$, and $1b_1$ and $1b_2$ readily disappear after the earthquake stops, and, therefore, the shear deformation of the glass screen 2 readily disappears after the earthquake stops.

When the V-shaped arm 16*b* rotates, a restoring moment is generated by the weights of the glass plates $1a_1$ and $1b_2$ because the V-shaped arm 16*b* is inverted. Thus, the V-shaped arm 16*b* readily restores to the original equilibrium state after the earthquake stops. As a result, the in-plane vertical relative displacement between the glass plates $1a_2$ and $1b_2$ readily disappears after the earthquake stops, and, therefore, the shear deformation of the glass screen 2 readily disappears after the earthquake stops.

Dot point glazing apparatus 30

The V-shaped arm 16*b* supports the glass plates $1a_1$ and $1b_1$ against their weights as well as against the wind loads acting on them. The wind loads are transmitted from the arm 16*b* to the truss structure 200 in the same way as in the dot point glazing apparatus 10. The weights of the glass plates $1a_1$ and $1b_1$ together with the weights of the glass plates $1a_2$ and $1b_2$, $1a_3$ and $1b_3$ are transmitted to the structural member 300 through the bracket 130.

In-plane vertical relative displacement between the glass plates $1a_1$ and $1b_1$ is allowed by the rotation of the V-shaped arm 16*b*, while in-plane horizontal displacements of the glass plates $1a_1$ and $1b_1$ are allowed by the rotation of the straight arm 12. Thus, a shear deformation of the glass screen 2 is allowed when an earthquake occurs, which protects the glass screen 2 from damage.

When the straight arm 12 rotates, a restoring moment is generated by the weights of the glass plates $1a_1$ and $1b_1$. Thus, the straight arm 12 readily restores to the original equilibrium state after the earthquake stops. As a result, the in-plane horizontal displacements of the glass plates $1a_1$ and $1b_1$ readily disappear after the earthquake stops, and, therefore, the shear deformation of the glass screen 2 readily disappears after the earthquake stops.

When the V-shaped arm 16*b* rotates, a restoring moment is generated by the weights of the glass plates $1a_1$ and $1b_1$ because the arm 16*b* is inverted. Thus, the V-shaped arm 16*b* readily restores to the original equilibrium state after the earthquake stops. As a result, the in-plane vertical relative displacement between the glass plates $1a_1$ and $1b_1$ readily disappears after the earthquake stops, and, therefore the shear deformation of the glass screen 2 readily disappears after the earthquake stops.

Dot point glazing apparatus 40

The V-shaped arm 16*a* supports the glass plates $1a_3$ and $1b_3$ against the wind loads acting on them. The wind loads are transmitted from the V-shaped arm 16*a* to the truss structure 200 in the same way as in the dot point glazing apparatus 10.

In-plane vertical relative displacement between the glass plates $1a_3$ and $1b_3$ is allowed by the rotation of the V-shaped arm 16*a*, while in-plane horizontal displacement of the glass plates $1a_3$ and $1b_3$ is allowed by the rotation of the straight arm 12. Thus, a shear deformation of the glass screen 2 is allowed when an earthquake occurs, which protects the glass screen 2 from damage.

Dot point glazing apparatus 50

The straight arm 51*a* supports the glass plates $1a_1$ against the wind load acting on it. The straight arm 51*b* supports the glass plate $1a_2$ against its weight as well as against the wind load acting on it. The wind load is transmitted from the straight arms 51*a*, 51*b* to the truss structure 200 through the rod 11, the joint member 100 and the rod 120. The weight of the glass plate $1a_2$ together with the weight of the glass plate $1a_3$ are transmitted to the joint member 100 of the upwardly adjacent dot point glazing apparatus 60 through the upwardly extending rod 110.

In-plane horizontal relative displacement between the glass plates $1a_1$ and $1a_2$ is allowed by the rotation of the straight arm 12. Thus, a shear deformation of the glass screen 2 is allowed when an earthquake occurs, which protects the glass screen 2 from damage.

When the straight arm 12 rotates, a restoring moment is generated by the weight of the glass plate $1a_2$. Thus, the straight arm 12 readily restores to the original equilibrium state after the earthquake stops. As a result, the in-plane horizontal relative displacement between the glass plates $1a_1$ and $1a_2$ readily disappears after the earthquake stops, and, therefore, the shear deformation of the glass screen 2 readily disappears after the earthquake stops.

Dot point glazing apparatus 60 The straight arm 51*b* supports the glass plate $1a_1$ against its weight as well as against the wind load acting on it. The wind load is transmitted from the arm 51*b* to the truss structure 200 in the same way as in the dot point glazing apparatus 50. The weight of the glass plate $1a_1$ together with the weights of the glass plates $1a_2$, $1a_3$ are transmitted to the structural member 300 through the bracket 130.

In-plane horizontal displacement of the glass plate $1a_1$ at is allowed by the rotation of the straight arm 12. Thus, a shear deformation of the glass screen 2 is allowed when an earthquake occurs, which protects the glass screen 2 from damage.

When the straight arm 12 rotates, a restoring moment is generated by the weight of the glass plate $1a_1$. Thus, the straight arm 12 readily restores to the original equilibrium state after the earthquake stops. As a result, the in-plane horizontal displacement of the glass plate $1a_1$ readily disappears after the earthquake stops, and, therefore, the shear deformation of the glass screen 2 readily disappears after the earthquake stops.

Dot point glazing apparatus 70

The straight arm 51*a* supports the glass plates $1a_3$ against the wind load acting on it. The wind load is transmitted from the arms 51*a* to the truss structure 200 in the same way as in the dot point glazing apparatus 50.

In-plane horizontal displacement of the glass plate $1a_3$ is allowed by the rotation of the straight arm 12. Thus, a shear deformation of the glass screen 2 is allowed when an earthquake occurs, which protects the glass screen 2 from damage.

While the present invention has been described with reference to the preferred embodiments, one of ordinary skill in the art will recognize that modifications and improvements may be made while remaining within the spirit and scope of the present invention. The scope of the invention is determined solely by the appended claims.

I claim:

1. A dot point glazing apparatus for supporting plates, comprising:

a rod having an end;

a straight arm having a top end, a bottom end and a center, and being rotatably connected at the center to the end of the rod;

a first V-shaped arm having two ends and a center, and being rotatably connected at the center to the top end of the straight arm to rotate around an axis extending parallel to the rod;

a second V-shaped arm having two ends and a center, and being rotatably connected at the center to the bottom end of the straight arm to rotate around an axis extending parallel to the rod; and means connected to each of the ends of the first and second V-shaped arms for attaching to a plate.

2. An apparatus according to claim 1, wherein said means for attaching comprises a bolt threaded to each said end of the first and second V-shaped arms.

3. An apparatus according to claim 1, wherein said centers of the first and second V-shaped arms are yoke-shaped for engaging said straight arm.

4. A dot point glazing apparatus for supporting plates, comprising:

a rod having an end, a straight arm having first and second ends and a center, and being rotatably connected at the center to the end of the rod;

a V-shaped arm having two ends and a center, and being rotatably connected at the center to one of the first and second ends of the straight arm to be rotatable around an axis extending parallel to the rod;

means connected to each end of the V-shaped arm for attaching to a plate.

5. An apparatus according to claim 4, wherein said means for attaching comprises a bolt threaded to each said end of the V-shaped arm.

6. An apparatus according to claim 4, wherein said center of the V-shaped arm is yoke-shaped for engaging said straight arm.

7. A dot point glazing apparatus for supporting plates, comprising:

a rod having an end;

a first straight arm having a top end, a bottom end and a center, and being rotatably attached at the center to the end of the rod;

a second straight arm having first and second ends, the first end being rotatably connected to the top end of the first straight arm to be rotatable around an axis extending parallel to the rod;

a third straight arm having first and second ends, the first end being rotatably attached to the bottom end of the first straight arm to be rotatable around an axis extending parallel to the rod; and means connected to the second ends of the second and third straight arms for attaching to a plate.

8. An apparatus according to claim 7, wherein said means for attaching comprises a bolt threaded to each said second end of the second and third straight arms.

9. An apparatus according to claim 7, wherein said first ends of the second and third straight arms are yoke-shaped for engaging said first straight arm.

10. A dot point glazing apparatus for supporting plates, comprising:

a rod having an end;

a first straight arm having two ends and a center, and being rotatably connected to the end of the rod;

a second straight arm having first and second ends, the first end being rotatably connected to one end of the first straight arm to be rotatable around an axis extending parallel to the rod; and means connected to the second end of the second straight arm for attaching to a plate.

11. An apparatus according to claim 10, wherein said means for attaching comprises a bolt threaded to said second end of the second straight arm.

12. An apparatus according to claim 10, wherein said first end of the second straight arm is yoke-shaped for engaging said first straight arm.

13. A dot point glazing system for supporting plates, comprising:

(a) a first apparatus including a rod having an end;

a straight arm having a top end, a bottom end and a center, and being rotatably connected at the center to the end of the rod;

a first V-shaped arm having two ends and a center, and being rotatably connected at the center to the top end of the straight arm to rotate around an axis extending parallel to the rod;

a second V-shaped arm having two ends and a center, and being rotatably connected at the center to the bottom end of the straight arm to rotate around an axis extending parallel to the rod; and means connected to each of the ends of the first and second V-shaped arms for attaching to a plate;

(b) a plurality of second apparatuses including a rod having an end;

a straight arm having first and second ends and a center, and being rotatably connected at the center to the end of the rod;

a V-shaped arm having two ends and a center, and being rotatably connected at the center to one of the first and second ends of the straight arm to be rotatable around an axis extending parallel to the rod;

means connected to each end of the V-shaped arm, for attaching to a plate;

(c) a plurality of third apparatuses including a rod having an end;

a first straight having a top end, a bottom end and a center, and being rotatably attached at the center to the end of the rod;

a second straight arm having first and second ends, the first end being rotatably connected to the top end of the first straight arm to be rotatable around an axis extending parallel to the rod;

a third straight arm having first and second ends, the first end being rotatably attached to the bottom end of the first straight arm to be rotatable around an axis extending parallel to the rod; and means connected to the second ends of the second and third straight arms for attaching to a plate;

(d) a plurality of fourth apparatuses including a rod having an end;

a first straight arm having two ends and a center, and being rotatably connected to the end of the rod;

a second straight arm having first and second ends, the first end being rotatably connected to one end of the first straight arm to be rotatable around an axis extending parallel to the rod; and means connected to the second end of the second straight arm for attaching to a plate; and (e) a framework connected to the rods of the first, second, third and fourth apparatuses to support the apparatuses and plates connected to the apparatuses.

14. An system according to claim 13, wherein said means for attaching to a plate comprises a bolt threaded to (a) each of said ends of the V-shaped arms of the first and second apparatuses, (b) each of said second ends of the second and third straight arms of the third apparatuses, and (c) each of said second ends of the second straight arm of the fourth apparatuses.

15. An apparatus according to claim 13, wherein said centers of the V-shaped arms of the first and second apparatuses are yoke-shaped for engaging said straight arms, and said first ends of the second and third straight arms of the third and fourth apparatuses are yoke-shaped for engaging said first straight arms.

* * * * *